US010995920B1

(12) United States Patent
He

(10) Patent No.: US 10,995,920 B1
(45) Date of Patent: May 4, 2021

(54) FLAME SIMULATION LIGHT WITH AN INNER LIGHT SOURCE SURROUNDED BY LIGHT EMITTING PLATES

(71) Applicant: Fujian Quanzhou Fanta Crafts Co., Ltd., Fujian (CN)

(72) Inventor: Ke He, Fujian (CN)

(73) Assignee: Fujian Quanzhou Fanta Crafts Co., Ltd., Fujian (CN)

( * ) Notice: Subject to any disclaimer, the term of this patent is extended or adjusted under 35 U.S.C. 154(b) by 0 days.

(21) Appl. No.: 15/930,432

(22) Filed: May 12, 2020

(30) Foreign Application Priority Data

Apr. 3, 2020 (CN) ..... 202020478485.6

(51) Int. Cl.
*F21S 10/04* (2006.01)
*F21Y 107/50* (2016.01)
*F21S 6/00* (2006.01)

(52) U.S. Cl.
CPC ..... *F21S 10/043* (2013.01); *F21S 6/001* (2013.01); *F21Y 2107/50* (2016.08)

(58) Field of Classification Search
CPC ..... F21K 9/232; F21K 9/27; F21W 2121/00; F21W 2121/002; F21Y 2107/30; F21Y 2107/40; F21Y 2107/50; F21S 6/001; F21S 10/04; F21S 10/043; F21S 10/046
See application file for complete search history.

(56) References Cited

U.S. PATENT DOCUMENTS 4,467,193 A * 8/1984 Carroll ..... G01V 8/20 250/216
9,097,412 B1 * 8/2015 Pinato ..... F21V 29/70
9,801,250 B1 * 10/2017 Halliwell ..... H05B 45/10
2004/0085030 A1 * 5/2004 Laflamme ..... F21V 23/045 315/291
2014/0362565 A1 * 12/2014 Yao ..... H01L 25/0753 362/223
2018/0168047 A1 * 6/2018 Van Uden ..... H05K 1/189
2018/0233492 A1 * 8/2018 Liu ..... H01L 33/62
2018/0328543 A1 * 11/2018 Bergmann ..... H05B 45/3577
2019/0203921 A1 * 7/2019 He ..... F21V 7/22
2019/0219238 A1 * 7/2019 Yin ..... F21V 3/02

* cited by examiner

*Primary Examiner* — Rajarshi Chakraborty
*Assistant Examiner* — Steven Y Horikoshi
(74) *Attorney, Agent, or Firm* — JCIP Global Inc.

(57) ABSTRACT

A flame simulation light comprises a light base and a light housing. The light base is provided with a plurality of light-emitting plates extending in the direction away from the light base. The adjacent light-emitting plates are arranged end to end and enclose a cavity with gaps. At least an inner light source is arranged in the cavity to emit light through the gaps. Therefore, a flame is simulated more realistically compared with conventional flame simulation light. Further, different light effects can be observed from different angles, which makes the flame simulation light more interesting. In addition, this manner of simulating flame can have diverse flame effects by changing inclination, arc, height, width, or shape of the light-emitting plates. In terms of the effect of having inner and outer flames, various combinations are possible. Compared with conventional integral flame simulation light, this flame simulation light realizes diversity.

20 Claims, 13 Drawing Sheets

FLAME SIMULATION LIGHT WITH AN INNER LIGHT SOURCE SURROUNDED BY LIGHT EMITTING PLATES

CROSS-REFERENCE TO RELATED APPLICATION

This application claims the priority benefit of China application No. 202020478485.6, filed on Apr. 3, 2020. The entirety of the above-mentioned patent application is hereby incorporated by reference herein and made a part of this specification.

BACKGROUND

Technical Field

The present invention relates to a technical field of light, in particular to a flame simulation light.

Description of Related Art

As society advances, people's quality of life is being improved. Decorative lights are used not only for illumination, but also for decorative purposes, which brings the sense of beauty.

A flame simulation light is used to simulate flame. Since there is no combustion product that is harmful to environment and human health and there is no fire risk, the flame simulation light can be widely used for decorating party, home, environment and the like. However, the flame effect of conventional flame simulation lights is not realistic and the light effect is not good, which prevents the popularization and application of the conventional flame simulation lights.

SUMMARY

The objective of the present application is to provide a flame simulation light that has a realistic flame effect and a good light effect.

The above objective of the present application is implemented through the technical solutions as follows.

A flame simulation light comprises a light base and a light housing. The light base is provided with a plurality of light-emitting plates extending in the direction away from the light base. The adjacent light-emitting plates are arranged end to end and enclose a cavity with gaps. At least an inner light source is arranged in the cavity to emit light through the gaps. A light-emitting surface of each sheet-like light source faces outward, and the light housing accommodates the sheet-like light sources which are enclosed.

According to the technical scheme, the light-emitting plates have an outer flame effect at its outer sides. The inner light source emits light in the cavity, and the light is projected outwardly through the gaps to have the inner flame effect. Therefore, a flame is simulated more realistically compared with conventional flame simulation light. Further, different light effects can be observed from different angles, which makes the flame simulation light more interesting and creates a good lighting atmosphere. This manner of simulating flame can have diverse flame effects by changing inclination (including orientation), arc (including orientation), height, width, or shape of the light-emitting plates, or by changing shape or dimension of gaps. In terms of the effect of having inner and outer flames, various combinations are possible. Compared with conventional integral flame simulation light, this flame simulation light realizes diversity and is widely used for a variety of purposes.

Further, the inner light source is colored light bead emitting light of a plurality of colors.

According to the technical scheme, the flame effects of having different temperatures or different colors, such as a cyan inner flame and a yellow outer flame, can be achieved. The flame simulation is more realistic. Therefore, the flame simulation light can be used in different periods such as sunset time or night time to create different atmosphere, or can be applied to various applications such as weddings or funerals.

Further, the inner light source is a sheet-like light source attached to the center of the bottom of the cavity.

According to the technical scheme, the light of the sheet-like light source has a uniform distribution. The sheet-like light source emits light emits divergent light upward, and generates a halo in combination with light mixing and reflection from the light housing.

Further, the inner light source is a light group having three primary-color light beads or sheet-like light sources.

According to the technical scheme, colored light can be emitted based on three primary colors of light.

Further, three light beads or sheet-like light sources are arranged to surround a center of the cavity, and each of light beads or sheet-like light sources respectively corresponds to the center of each light-emitting plate.

According to the technical scheme, each gap corresponds to an adjacent light mixing area of at least two light beads to ensure a good light mixing effect caused by the light being projected through the gaps.

Further, the light base is provided with a switch for adjusting brightness and color of the light-emitting plates and the inner light source.

According to the technical scheme, brightness and color of the inner light source and the outer light sources can be adjusted or combined according to the practical application environment.

Further, the flame simulation light further comprises a remote controller that is provided with a switch for adjusting brightness and color of the light-emitting plates and the inner light source, and the remote controller and the substrate are respectively provided with a transmit module and a receive module that are matched with each other.

According to the technical scheme, brightness and color of the inner light source and the outer light sources can be adjusted or combined remotely according to the practical application environment. Further, a retroreflective layer or a retroreflective sheet is attached to a back surface of each light-emitting plate.

According to the technical scheme, the sheet-like light sources face the gaps, and the retroreflective layer or sheet can reflect light through the gaps, such that the brightness is improved and the contrast of the inner bright and the outer bright is increased.

Further, each of the light-emitting plates includes a carrier plate and nine sheet-like sources fixed on the carrier plate. These sheet-like light sources are arranged in four rows, in which the first row has one sheet-like light source, the second row has three sheet-like light sources, the third row has three sheet-like light sources, and the fourth row has two sheet-like light sources. The sheet-like light sources of the second row and of the third row are offset from each other in column direction. The sheet-like light source of the first row is in the same column as the left sheet-like light source of the second row. The two sheet-like light sources of the fourth row are respectively in the same column as the right two sheet-like light sources of the third row.

According to the technical scheme, the numbers of the light sources in the column direction are different, such that the trembling flame can be simulated more realistically.

Further, the carrier plate is made of transparent material.

According to the technical scheme, the blurry image can be achieved to produce warm light atmosphere.

Further, the number of the light-emitting plates is three, and the light-emitting plates are uniformly distributed in the light base.

According to the technical scheme, there is sufficient room for the light sources in the light-emitting plates such that the light sources are arranged to simulate trembling flame. In terms of the effect of having inner and outer flames, the arrangement of the three light-emitting plates has the lowest cost.

Further, two of the three light-emitting plates have the same height, while the other one has a bigger height, and wherein a retroreflective layer or a retroreflective sheet is attached to the back surface of the light-emitting plate having the biggest height.

According to the technical scheme, the inner and outer flames can be achieved at the same time to achieve a special effect of flame.

Further, the heights of the plurality of light-emitting plates alternate in the light-emitting plates' enclosing direction.

According to the technical scheme, different light effects can be observed from different angles. In addition, the inner and outer flames can be achieved at the same time to achieve a special effect of flame.

Further, the widths of the plurality of light-emitting plates are increased sequentially from the first to the last in the light-emitting plates' enclosing direction.

According to the technical scheme, asymmetrical flame in windy areas can be simulated.

Further, the light-emitting plates are inclined relative to the light base, and their tops get closer to one another relative to their bottoms.

According to the technical scheme, the image of flame that is gradually blurred from its bottom to top can be achieved. In addition, the inner flame becomes thinner gradually upward with height to simulate the inner and outer flames more realistically.

Further, the light-emitting plates are inclined relative to the light base, in which some light-emitting plates' tops face away from each other relative to their bottoms, and some light-emitting plates' tops get closer to each other relative to their bottoms.

According to the technical scheme, different blurred images between the upper part and the lower part of the flame can be observed from different angles to obtain a dynamic effect.

Further, the light-emitting plates are flexible. The surfaces of the six light-emitting plates are curved. Furthermore, their tops are enclosed together, and their centers are closing to one another.

According to the technical scheme, the flame of oil lamp and candle can be simulated.

Further, the light-emitting plates' top edges are curved.

According to the technical scheme, the top of the flame is brighter in the surrounding area.

Further, an inner light source is arranged to correspond to each gap of the cavity, and the inner light sources are respectively located at sides of the gaps of the cavity.

According to the technical scheme, the inner flame of the flame simulation is brighter.

Further, the inner light source is pin-base light bead, and a spherical reflector is arranged in the cavity. Pins of the pin-base light beads extend through the center of the spherical reflector.

According to the technical scheme, a better light effect is achieved since light is projected in surrounding directions by the pin-base light bead. Further, the spherical increases the effect of projecting the light in surrounding directions to make the inner flame brighter.

In summary, the beneficial effects of the present invention are as follow.

The light-emitting plates have an outer flame effect at its outer sides. The inner light source emits light in the cavity, and the light is projected outwardly through the gaps to have the inner flame effect. Therefore, a flame is simulated more realistically compared with conventional flame simulation light. Further, different light effects can be observed from different angles, which makes the flame simulation light more interesting and creates a good lighting atmosphere.

This manner of simulating flame can have diverse flame effects by changing inclination (including orientation), arc (including orientation), height, width, or shape of the light-emitting plates, or by changing shape or dimension of gaps. In terms of the effect of having inner and outer flames, various combinations are possible. Compared with conventional integral flame simulation light, this flame simulation light realizes diversity and is widely used for a variety of purposes.

DESCRIPTION OF THE EMBODIMENTS

The present application is further illustrated in detail in combination with the accompanying drawings hereinafter.

Embodiment I

Figure 1:
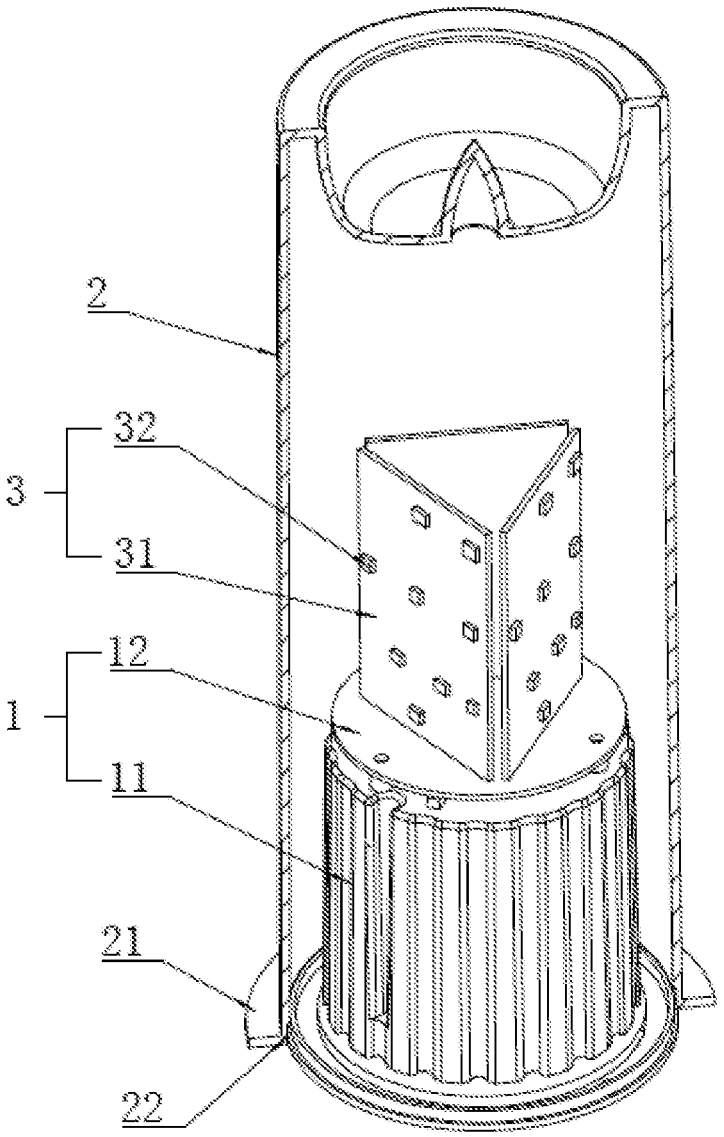
FIG. 1 is a schematic structural view of a flame simulation light of embodiment I.
Figure 2:
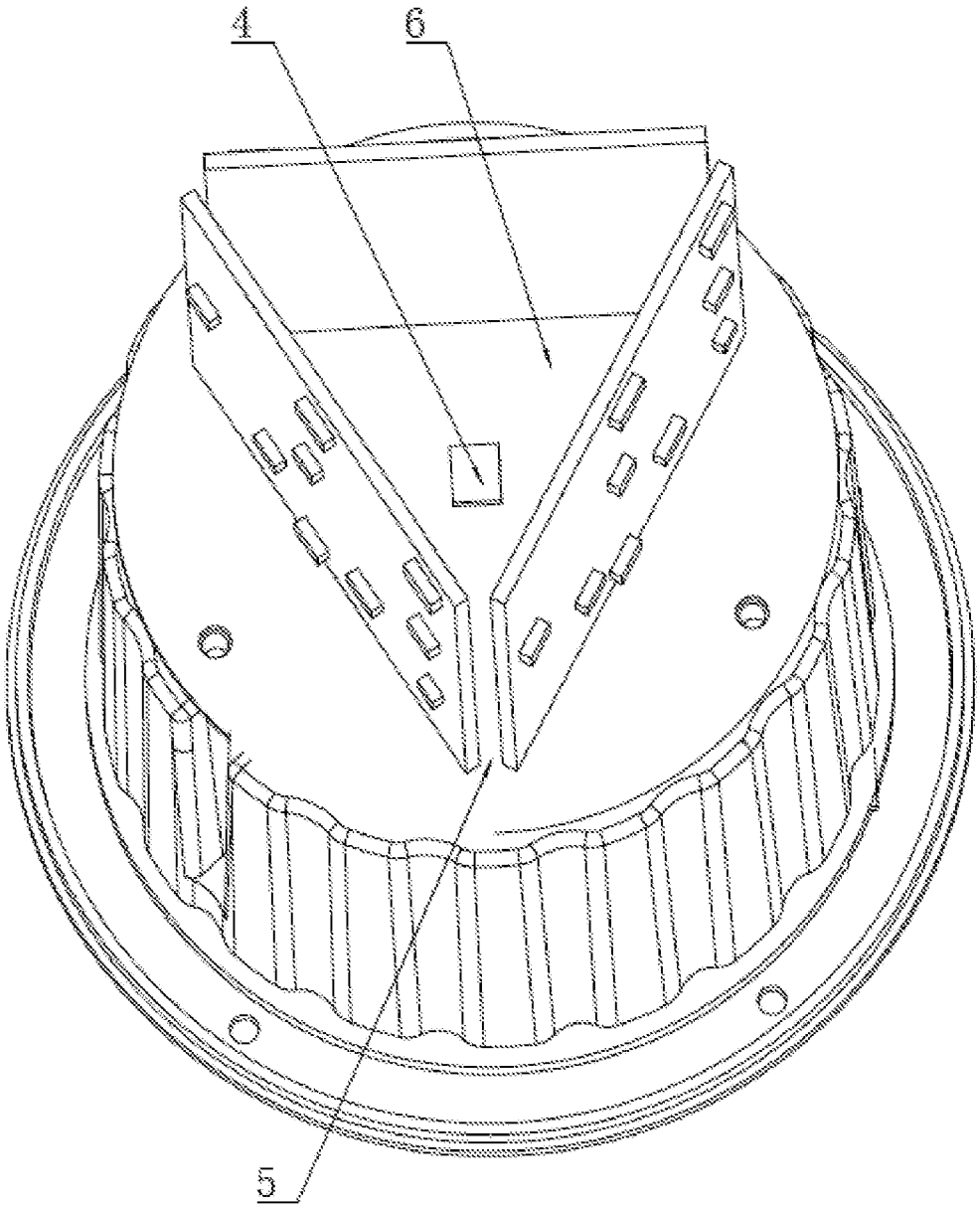
FIG. 2 is a structural view of a light base and light-emitting plates of the flame simulation light of embodiment I.

Referring to FIG. 1 and FIG. 2, the present application relates to a flame simulation light. The flame simulation light includes a light base 1 and a light housing 2. The bottom of the light housing 2 is provided with an outer ring 21 that extends radially outwardly from the outer wall of the bottom, such that screw is fixed. The light housing 2 covers the light base 1 at the peripheral side of the light base 1. A groove 22 is arranged in the inner side of the bottom of the light housing 2. The peripheral side of the bottom of the light base 1 is engaged in the groove 22 and is glued to the light housing 2.

The light housing 1 includes a battery case 11 and a substrate 12 that is electrically connected to the top of the battery case 11. Three light-emitting plates 3 are vertically arranged on the substrate 12 of the light base 1 and are electrically connected to the light base 1. The light emitting surfaces of the light-emitting plates 3 face outward, while the back surfaces of the light-emitting plates 3 are electroplated with light reflection layers or attached with reflective sheets. The adjacent light-emitting plates 3 are arranged end to end so as to form a cavity 6 with gaps 5. Any two of the extension planes of the three light-emitting plates 3 intersect each other such that a substantially equilateral triangle is formed. At least an inner light source 4 that emits light to the gaps 5 is arranged in the cavity 6. The inner light source 4, which is a sheet-like light source 32, is attached to the center of the bottom of the cavity 6 and is electrically connected to the substrate 12.

Each of the light-emitting plates 3 includes a carrier plate 31 and nine sheet-like sources 32 fixed on the carrier plate 31. These sheet-like light sources 32 are arranged in four rows, in which the first row has one sheet-like light source, the second row has three sheet-like light sources, the third row has three sheet-like light sources, and the fourth row has two sheet-like light sources. The sheet-like light sources 32 of the second row and of the third row are offset from each other in column direction. The sheet-like light source 32 of the first row is in the same column as the left sheet-like light source 32 of the second row. The two sheet-like light sources 32 of the fourth row are respectively in the same column as the right two sheet-like light sources of the third row.

Figure 3:
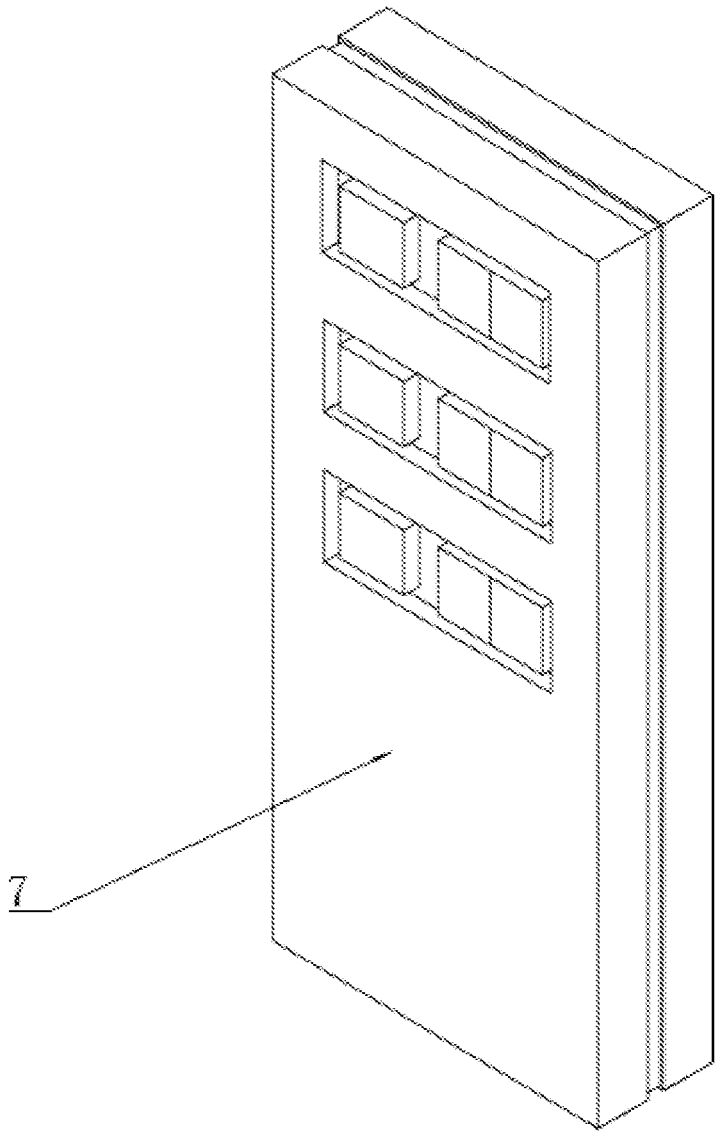
FIG. 3 is a schematic structural view of a remote controller of embodiment I.

Referring to FIG. 3, the substrate 12 is provided with a switch for adjusting brightness and color of the light-emitting plates 3 and the inner light source 4. The flame simulation light is further provided with a remote controller 7 for the flame simulation light. The remote controller 7 is provided with a switch for adjusting brightness and color of the light-emitting plates 3 and the inner light source 4. The remote controller 7 and the substrate 12 are respectively provided with a transmit module and a receive module that are matched with each other.

The operation principle is as follows:

The light-emitting plates 3 have an outer flame effect at its outer sides. The inner light source 4 emits light in the cavity, and the light is projected outwardly through the gaps 5 to have the inner flame effect. Therefore, a flame is simulated more realistically compared with conventional flame simulation light. Further, different light effects can be observed from different angles, which makes the flame simulation light more interesting and creates a good lighting atmosphere. This manner of simulating flame can have diverse flame effects by changing inclination (including orientation), arc (including orientation), height, width, or shape of the light-emitting plates 3, or by changing shape or dimension of gaps 5. In terms of the effect of having inner and outer flames, various combinations are possible. Compared with conventional integral flame simulation light, this flame simulation light realizes diversity and is widely used for a variety of purposes.

Embodiment II

Embodiment II is different from embodiment I in the following aspect. The inner light source 4 can be colored light bead emitting light of a plurality of colors.

Embodiment III

Figure 4:
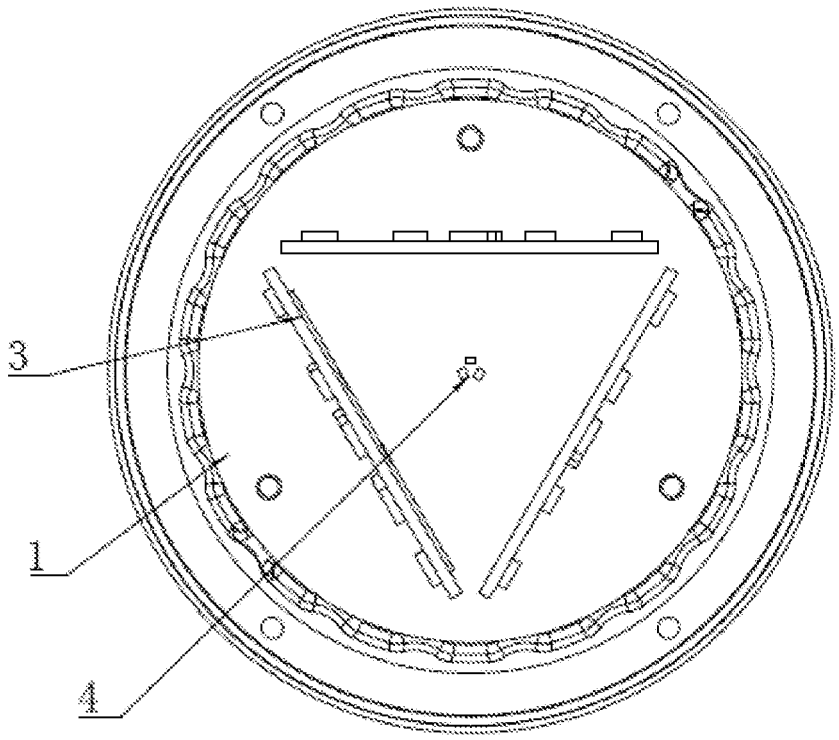
FIG. 4 is a top view showing an internal configuration of a flame simulation light of embodiment III.

Embodiment III as shown in FIG. 4 is different from embodiment I in the following aspects. The inner light source 4 can be a light group having three primary-color light beads or sheet-like light sources. The three light beads or the sheet-like light sources are arranged to surround the center of the cavity 6. Each of light beads or sheet-like light sources respectively corresponds to the center of each light-emitting plate 3.

Embodiment IV

Embodiment IV is different from embodiment I in the following aspect. The carrier plate 31 can be made of transparent material.

Embodiment V

Figure 5:
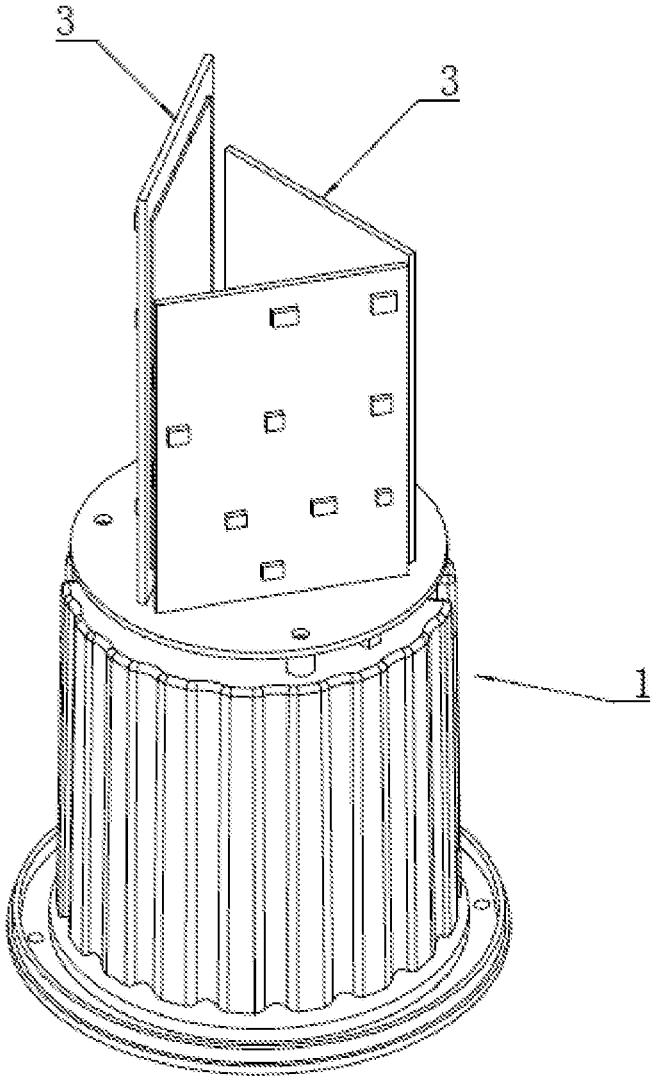
FIG. 5 is a schematic view showing an internal configuration of a flame simulation light of embodiment V.

Embodiment V as shown in FIG. 5 is different from embodiment I in the following aspects. Two of the three light-emitting plates have the same height, while the other one has a bigger height. A retroreflective layer or a retroreflective sheet is attached to the back surface of the light-emitting plate 3 having the biggest height.

Embodiment VI

Figure 6:
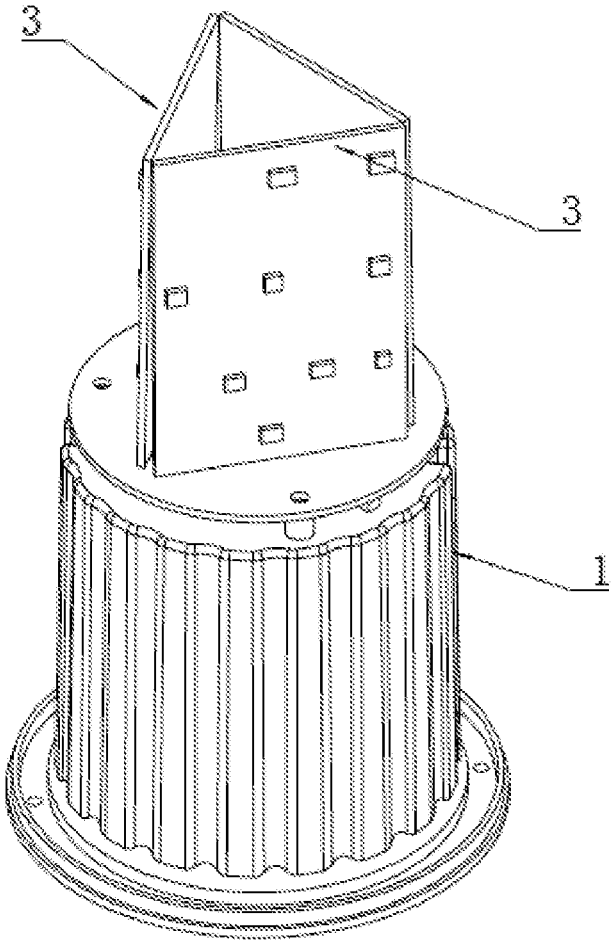
FIG. 6 is a schematic view showing an internal configuration of a flame simulation light of embodiment VI.

Embodiment VI as shown in FIG. 6 is different from embodiment I in the following aspect. The light-emitting plates 3 are inclined relative to the light base 1, and their tops get increasingly closer to one another.

Embodiment VII

Figure 7:
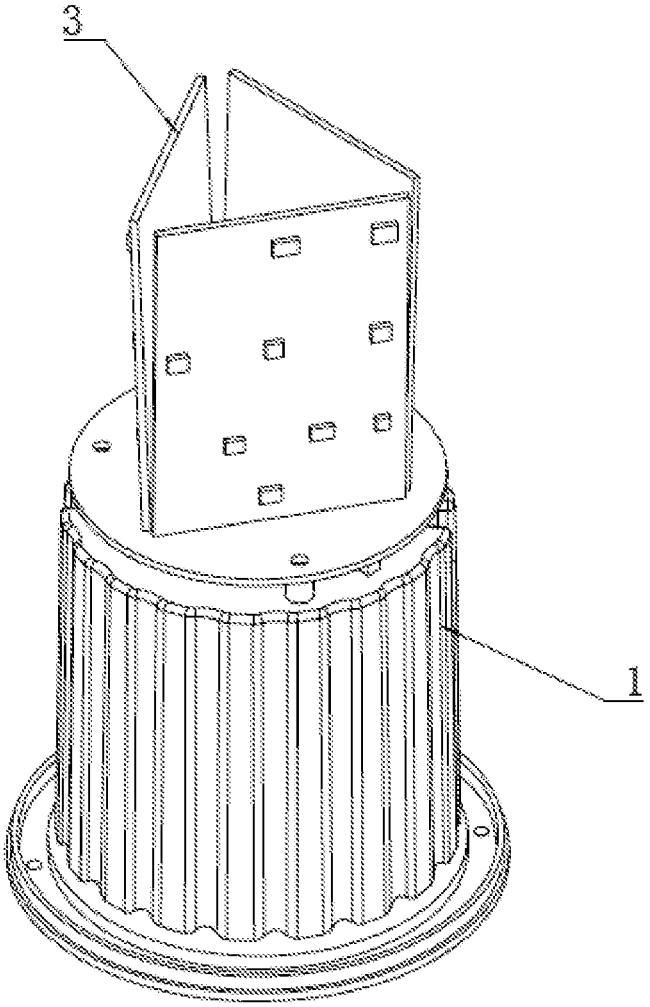
FIG. 7 is a schematic view showing an internal configuration of a flame simulation light of embodiment VII.

Embodiment VII as shown in FIG. 7 is different from embodiment I in the following aspect. The light-emitting plates 3 are inclined relative to the light base 1, in which some light-emitting plates' tops face away from each other relative to their bottoms, and some light-emitting plates' tops get closer to each other relative to their bottoms.

Embodiment VIII

Figure 8:
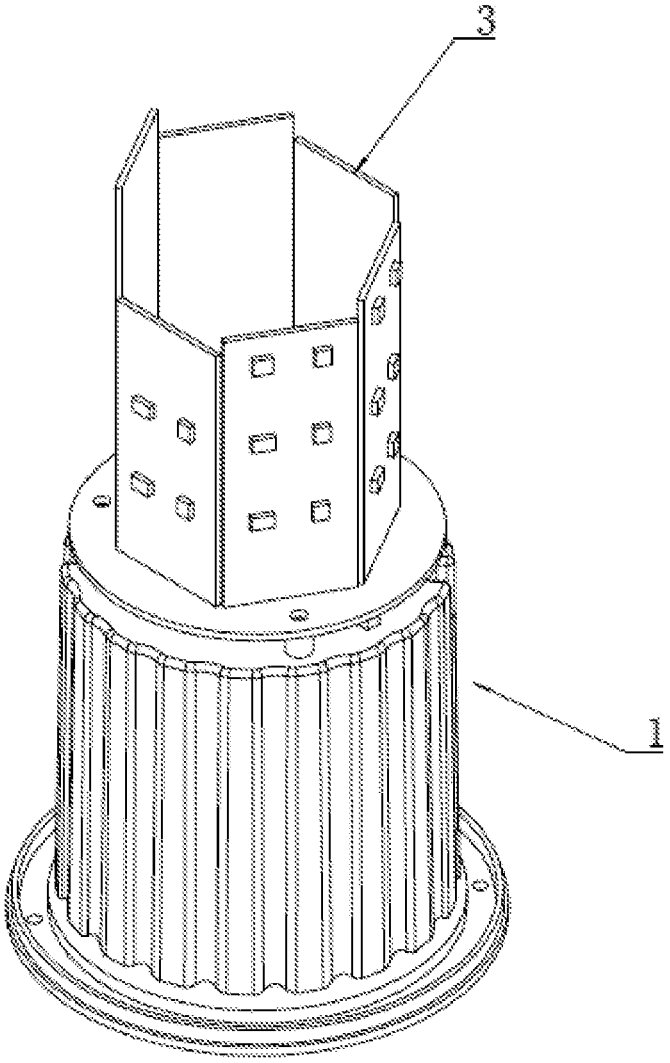
FIG. 8 is a schematic view showing an internal configuration of a flame simulation light of embodiment VIII.

Embodiment VIII as shown in FIG. 8 is different from embodiment I in the following aspect. The number of the light-emitting plates 3 is six. The heights of the six light-emitting plates 3 alternate in the light-emitting plates' enclosing direction.

Embodiment IX

Figure 9:
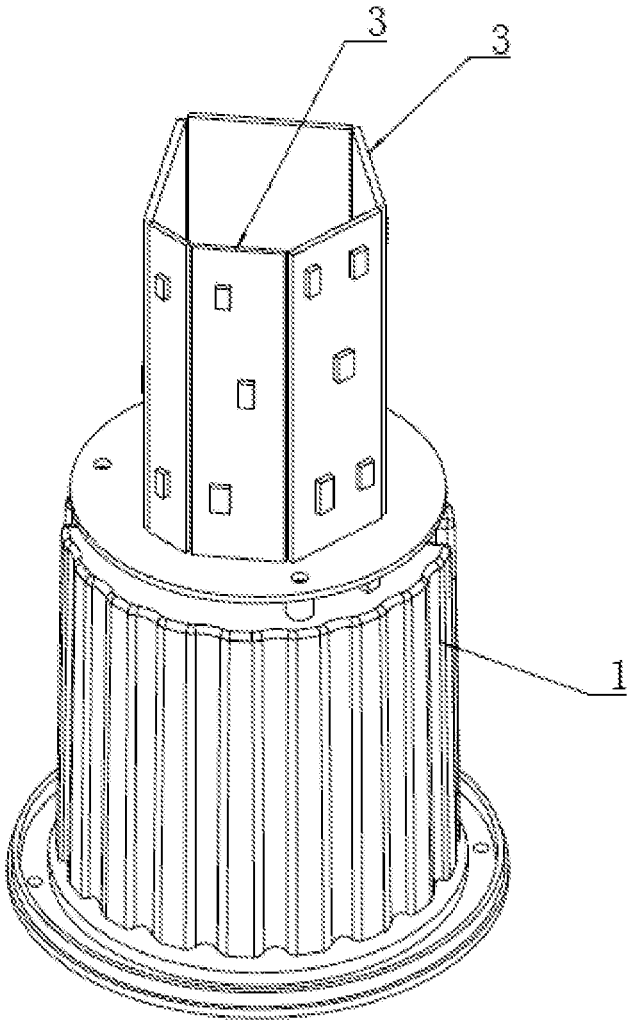
FIG. 9 is a schematic view showing an internal configuration of a flame simulation light of embodiment IX.

Embodiment IX as shown in FIG. 9 is different from embodiment I in the following aspect. The number of the light-emitting plates 3 is six. The widths of the six light-emitting plates 3 are increased sequentially from the first to the last.

Embodiment X

Figure 10:
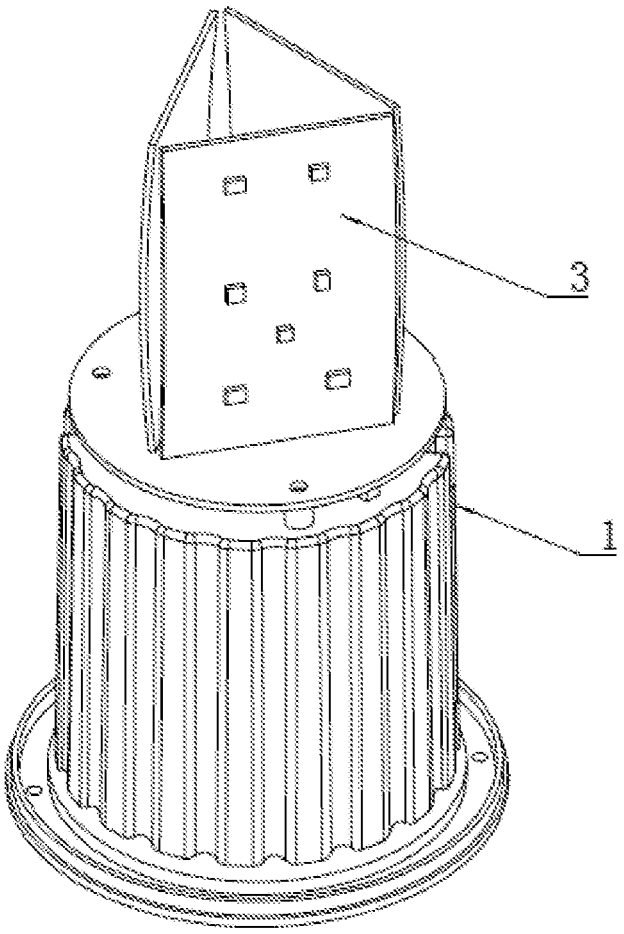
FIG. 10 is a schematic view showing an internal configuration of a flame simulation light of embodiment X.

Embodiment X as shown in FIG. 10 is different from embodiment I in the following aspects. The light-emitting plates 3 are flexible. The surfaces of the light-emitting plates 3 are curved. In addition, their tops are enclosed together, and their centers are closing to one another.

Embodiment XI

Figure 11:
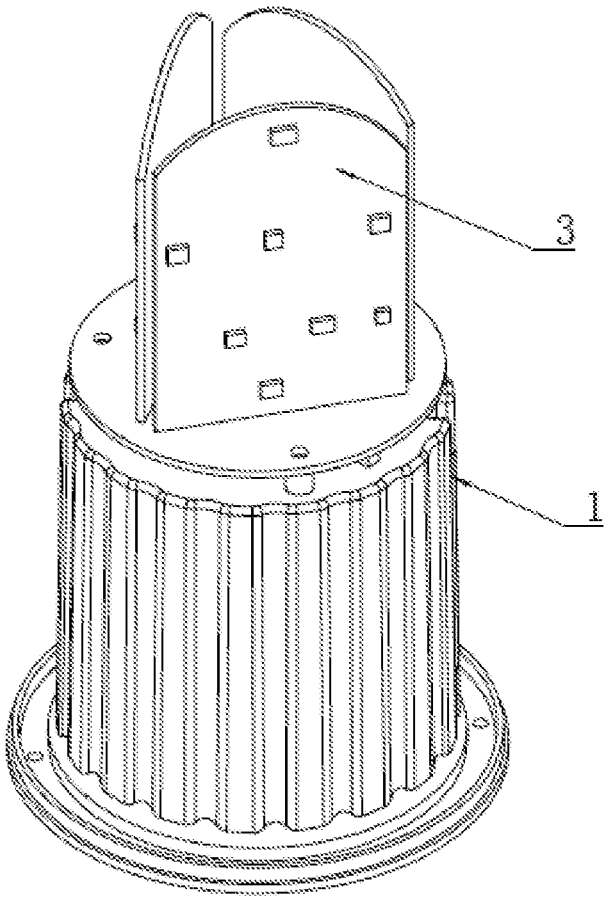
FIG. 11 is a schematic view showing an internal configuration of a flame simulation light of embodiment XI.

Embodiment XI as shown in FIG. 11 is different from embodiment I in the following aspect. The light-emitting plates' top edges are curved.

Embodiment XII

Figure 12:
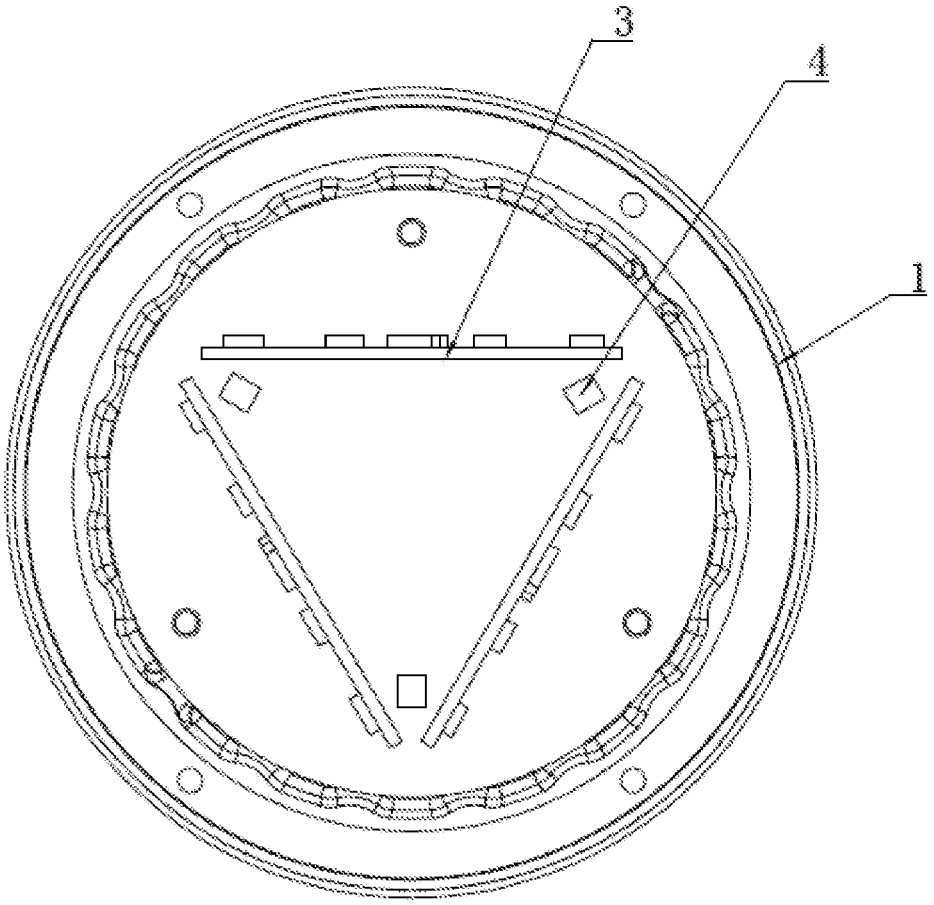
FIG. 12 is a top view showing an internal configuration of a flame simulation light of embodiment XII.

Embodiment XII as shown in FIG. 12 is different from embodiment I in the following aspects. An inner light source 4 is arranged to correspond to each gap 5 of the cavity 6. The inner light sources 4 are respectively located at sides of the gaps 5 of the cavity 6.

Embodiment XIII

Figure 13:
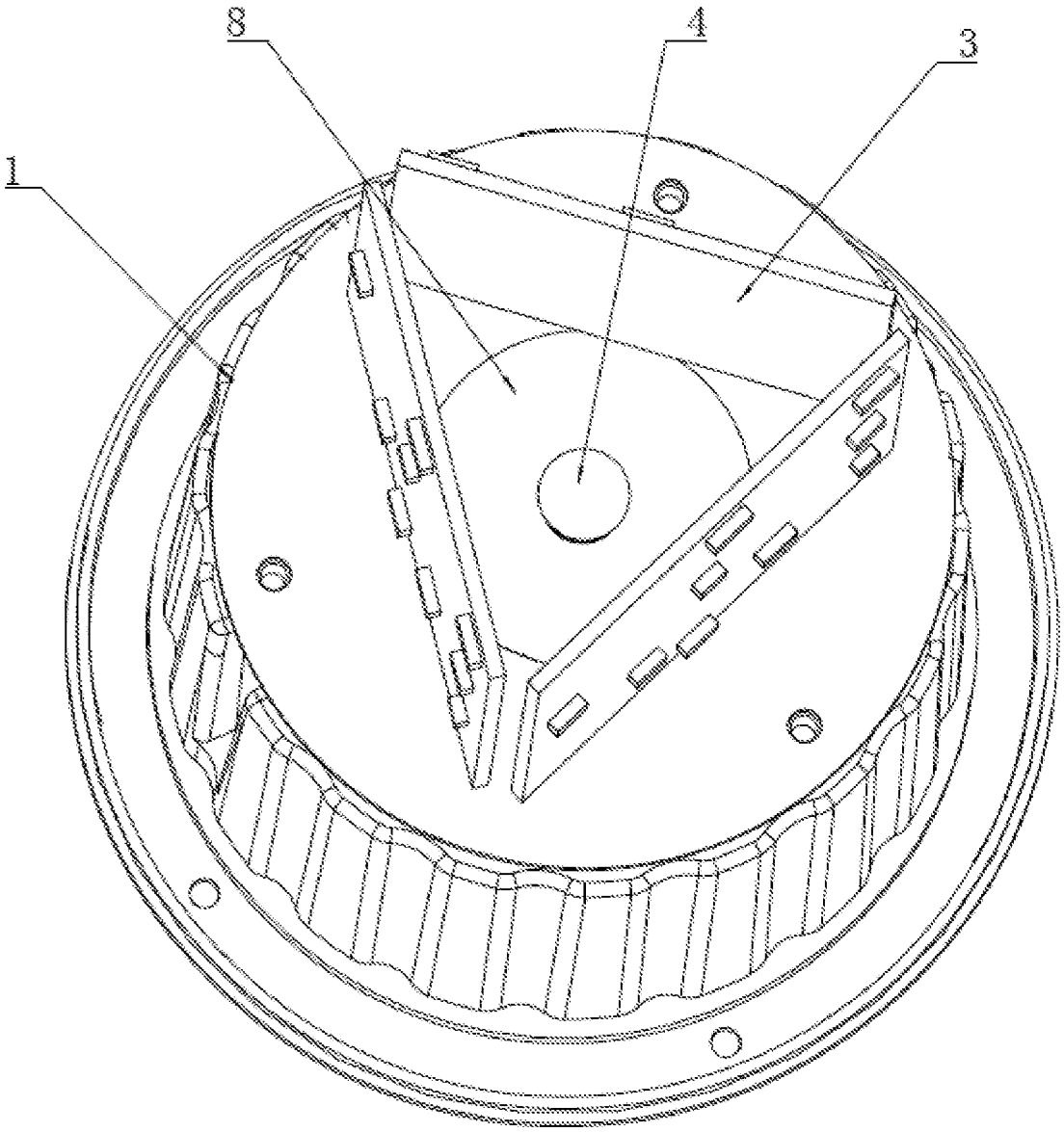
FIG. 13 is a perspective view showing an internal configuration of a flame simulation light of embodiment XIII.

Embodiment XIII as shown in FIG. 13 is different from embodiment I in the following aspects. The inner light source 4 is pin-base light bead. A spherical reflector 8 is arranged in the cavity. Pins of the pin-base light beads extend through the center of the spherical reflector 8.

The above description is only preferred embodiments of the present invention and is not intended to limit the protection scope of the present invention. Therefore, all equivalent changes of the structure, shape or principle according to the spirit of the present invention should be all included in the protection scope of the present invention.

What is claimed is:

1. A flame simulation light, comprising a light base and a light housing, wherein the light base is provided with a plurality of light-emitting plates extending in the direction away from the light base, wherein each of the plurality of light-emitting plates has flat light sources thereon, the adjacent light-emitting plates are arranged end to end and enclose a cavity with gaps, at least an inner light source is arranged in the cavity to emit light through the gaps, a light-emitting surface of each of the flat light sources on the light-emitting plates faces outward, and the light housing accommodates the sheet like flat light sources which are enclosed, wherein the number of the light-emitting plates is three, and the light-emitting plates are uniformly distributed in the light base, wherein two of the three light-emitting plates have the same height, while the other one has a bigger height, and wherein a retroreflective layer or a retroreflective sheet is attached to the back surface of the light-emitting plate having the biggest height.

2. The flame simulation light according to claim 1, wherein the inner light source is colored light bead emitting light of a plurality of colors.

3. The flame simulation light according to claim 1, wherein the inner light source is a flat light source attached to the center of the bottom of the cavity.

4. The flame simulation light according to claim 1, wherein the inner light source is a light group having three primary-color light beads or flat light sources.

5. The flame simulation light according to claim 4, wherein the three light beads or flat light sources are arranged to surround a center of the cavity, and each of light beads or flat light sources respectively corresponds to the center of each light-emitting plate.

6. The flame simulation light according to claim 1, wherein the light base is provided with a switch for adjusting brightness and color of the light-emitting plates and the inner light source.

7. The flame simulation light according to claim 1, wherein the flame simulation light further comprises a remote controller that is provided with a switch for adjusting brightness and color of the light-emitting plates and the inner light source, and the remote controller and the substrate are respectively provided with a transmit module and a receive module that are matched with each other.

8. The flame simulation light according to claim 1, wherein a retroreflective layer or a retroreflective sheet is attached to a back surface of each light-emitting plate.

9. The flame simulation light according to claim 1, wherein each of the light-emitting plates includes a carrier plate and nine flat sources fixed on the carrier plate, wherein the flat light sources are arranged in four rows, in which the first row has one flat light source, the second row has three flat light sources, the third row has three flat light sources, the fourth row has two flat light sources, wherein the flat light sources of the second row and of the third row are offset from each other in column direction, and the flat light source of the first row is in the same column as the left flat light source of the second row, and the two flat light sources of the fourth row are respectively in the same column as the right two flat light sources of the third row.

10. The flame simulation light according to claim 9, wherein the carrier plate is made of transparent material.

11. The flame simulation light according to claim 1, wherein the heights of the plurality of light-emitting plates alternate in the light-emitting plates' enclosing direction.

12. The flame simulation light according to claim 1, wherein the widths of the plurality of light-emitting plates are increased sequentially from the first to the last.

13. The fountain light according to claim 1, wherein the light-emitting plates are inclined relative to the light base, and their tops get closer to one another.

14. The fountain light according to claim 1, wherein the light-emitting plates are inclined relative to the light base, and their tops get closer to one another relative to their bottoms.

15. The fountain light according to claim 1, wherein the light-emitting plates are inclined relative to the light base, in which the light emitting plates' tops are farther away from each other relative to their bottoms.

16. The flame simulation light according to claim 1, wherein the light-emitting plates' top edges are curved.

17. The flame simulation light according to claim 1, wherein an inner light source is arranged to correspond to each gap of the cavity, and the inner light sources are respectively located at sides of the gaps of the cavity.

18. The flame simulation light according to claim 1, wherein the inner light source is pin-base light bead, and wherein a spherical reflector is arranged in the cavity, and pins of the pin-base light beads extend through the center of the spherical reflector.

19. A flame simulation light, comprising a light base and a light housing, wherein the light base is provided with a plurality of light-emitting plates extending in the direction away from the light base, wherein each of the plurality of light-emitting plates has flat light sources thereon, the adjacent light-emitting plates are arranged end to end and enclose a cavity with gaps, at least an inner light source is arranged in the cavity to emit light through the gaps, a light-emitting surface of each of the flat light sources on the light-emitting plates faces outward, and the light housing accommodates the flat light sources which are enclosed, wherein the heights of the plurality of light-emitting plates alternate in the light-emitting plates' enclosing direction.

20. A flame simulation light, comprising a light base and a light housing, wherein the light base is provided with a plurality of light-emitting plates extending in the direction away from the light base, wherein each of the plurality of light-emitting plates has flat light sources thereon, the adjacent light-emitting plates are arranged end to end and enclose a cavity with gaps, at least an inner light source is arranged in the cavity to emit light through the gaps, a light-emitting surface of each of the flat light sources on the light-emitting plates faces outward, and the light housing accommodates the flat light sources which are enclosed, wherein the widths of the plurality of light-emitting plates are increased sequentially from the first to the last.

* * * * *